United States Patent [19]

Murata et al.

[11] 4,102,825

[45] Jul. 25, 1978

[54] LIQUID LIGHT-DUTY DETERGENT COMPOSITION

[75] Inventors: Moriyasu Murata, Chiba; Kimie Ide, Tokyo, both of Japan

[73] Assignee: Kao Soap Co., Ltd., Tokyo, Japan

[21] Appl. No.: 831,954

[22] Filed: Sep. 9, 1977

[30] Foreign Application Priority Data

Oct. 1, 1976 [JP] Japan ..... 51-118332

[51] Int. Cl.[2] ..... C11D 1/38; C11D 3/26; C11D 7/32

[52] U.S. Cl. ..... 252/547; 252/8.75; 252/8.8; 252/8.9; 252/548; 252/DIG. 7; 252/DIG. 13; 252/DIG. 14; 252/DIG. 15

[58] Field of Search ..... 252/546, 547, 548, 8.8, 252/8.9, 8.75, DIG. 7, DIG. 13, DIG. 14, DIG. 15, 89 R

[56] References Cited

U.S. PATENT DOCUMENTS

| | | | |
|---|---|---|---|
| 3,537,993 | 11/1970 | Coward et al. | 252/547 X |
| 3,822,312 | 7/1974 | Sato et al. | 252/546 X |
| 3,849,348 | 11/1974 | Hewitt | 252/548 X |
| 3,850,818 | 11/1974 | Katsumi et al. | 252/547 X |
| 3,862,045 | 1/1975 | Sat et al. | 252/8.8 X |

*Primary Examiner*—Mayer Weinblatt

*Attorney, Agent, or Firm*—Blanchard, Flynn, Thiel, Boutell & Tanis

[57] ABSTRACT

A liquid light-duty detergent composition comprising a mixture of two cationic surfactants, an alkyl ethoxylate and, as an antiredeposition agent, a mixture of a fatty acid diethanolamide and an amphoteric surfactant.

5 Claims, No Drawings

LIQUID LIGHT-DUTY DETERGENT COMPOSITION

BACKGROUND OF THE INVENTION

1. Field of the Invention

The present invention relates to a liquid light-duty detergent composition. More particularly, the invention relates to a liquid light-duty detergent composition containing a cationic surface active agent. The composition is capable of imparting a soft finish to washed clothes. The composition is a homogeneous transparent liquid. The inherent defect of conventional detergent compositions of this type, namely, the lack of an antiredeposition effect, is overcome by the use of a combination of a specific fatty acid diethanolamide and a specific amphoteric surface active agent.

2. Description of the Prior Art

Sweaters, cardigans, holiday garments, formal clothing, evening wear and the like made of wool or chemical fibers have heretofore been customarily washed with light-duty detergents comprising, as a main surfactant component, a linear dodecylbenzenesulfonate, an alkylsulfate, an α-olefinsulfonate or mixture thereof. These main surfactant components are materials which are customarily used in heavy-duty detergent compositions, and they are not suitable for washing sweaters, cardigans, holiday garments, formal clothing, evening wear and the like for which a soft finish is required. Therefore, various light-duty detergent compositions containing a cationic surface active agent, which has been used as a fiber-softening agent, have heretofore been proposed in the art. For example, there can be mentioned (1) a detergent composition comprising a non-ionic surface active agent, a sulfobetaine, an amine oxide, coconut fatty acid diethanolamide, a builder, di-(tallow alkyl)dimethyl ammonium chloride and a specific polymeric compound (U.S. Pat. No. 3,537,993), (2) a detergent composition comprising a specific amine oxide and a specific cationic surface active agent (Japanese Patent Publication No. 4750/72 corresponding to U.S. Pat. No. 3,849,348), and (3) a liquid detergent composition formed by adding ethanol and water to a composition comprising a specific cationic surface active agent and a non-ionic surface active agent and/or an amine oxide (West German Laid-Open Specification No. 2,426,581).

As a result of our investigations made on these detergents, it was found that each of them is not completely satisfactory because of a lack of a sufficient antiredeposition property. Solid dirt particles are negatively charged in an aqueous washing liquor, and if the liquor contains a cationic surface active agent, it is absorbed on the negatively charged solid dirt particles with the hydrophobic group of the cationic surface active agent protruding toward or facing the water side. Therefore, the particles undergo sedimentation or cohesion, and they are finally deposited on the fibers, i.e., the dirt is redeposited on the fibers. This defect cannot be eliminated in conventional detergents comprising a cationic surface active agent.

It is therefore a primary object of the present invention to provide a liquid light-duty detergent composition in which this defect is eliminated and a good antiredeposition effect and washing power can be attained.

In general, it is very difficult to obtain a homogeneous transparent detergent containing a cationic surface active agent. For example, it is difficult to incorporate even a small amount of di-(tallow alkyl)dimethyl ammonium chloride stably in a solution or dispersion phase. There have heretofore been proposed stable fiber-softening compositions including the combination of an anionic fluorescent dye and a dialkyl quaternary ammonium salt (Japanese Patent Publication No. 35637/73), the combination of a polyethenoxy quaternary ammonium salt and a dialkyl quaternary ammonium salt (Japanese Patent Publication No. 41095/73) and the combination of a carboxybetaine, a non-ionic surface active agent, a polyethenoxy quaternary ammonium salt and a dialkyl quaternary ammonium salt (Japanese Patent Publication No. 10439/75 corresponding to U.S. Pat. No. 3,862,045). Further, West German Laid-Open Specification No. 2,426,581 proposes a stable detergent composition including a di-(tallow alkyl) quaternary ammonium salt. According to these proposals, however, it is impossible to obtain a transparent liquid softener or detergent that is stable at low temperature.

It is therefore a secondary object of the present invention to provide a stable liquid light-duty detergent capable of maintaining a transparent state even at low temperature.

In general, clothes washed with a detergent comprising a cationic surface active agent are soft and have a good feel, but this effect may be lost if some kinds of additives are incorporated in the detergent composition. For example, an anionic surface active agent or some specific non-ionic surface active agents drastically degrade the softening effect of the cationic surface active agent.

It is therefore a third object of the present invention to provide a liquid light-duty detergent in which the softening effect of the cationic surface active agent is not degraded, but rather is maintained at a high level.

SUMMARY OF THE INVENTION

In accordance with the present invention, the foregoing objects can be attained by a liquid light-duty detergent composition comprising, as main components, (1) from 1 to 5% by weight of a mixture of (a) a fatty acid diethanolamide derived from a saturated fatty acid having 10 to 14 carbon atoms and (b) an amphoteric surface active agent having the formula (1):

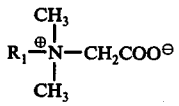

(I)

wherein $R_1$ is alkyl having 10 to 14 carbon atoms, wherein the weight ratio of the fatty acid diethanolamide (a) to the amphoteric surface active agent (b), namely the (a)/(b) weight ratio, is in the range of from 90/10 to 10/90, (2) from 0.5 to 5% by weight of a mixture of (c) a cationic surface active agent having the formula (II):

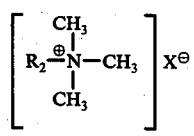

(II)

wherein $R_2$ is alkyl or alkenyl having 14 to 20 carbon atoms, and X is Cl or Br, and (d) a cationic surface active agent having the formula (III):

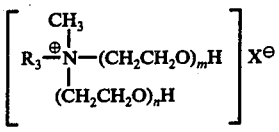

(III)

wherein $R_3$ is alkyl or alkenyl having 14 to 20 carbon atoms, *m* and *n* each stand for an integer of at least 1 with the proviso that the sum of *m* and *n* is in the range of from 2 to 8, and X is Cl or Br, wherein the weight ratio of the cationic surface active agent (c) and (d), namely the (c)/(d) weight ratio, is in the range of from 90/10 to 10/90, (3) from 15 to 30% by weight, preferably from 20 to 25% by weight, of an alkyl ethoxylate formed by adding from 3 to 12 moles of ethylene oxide to one mole of an alkanol having 12 to 15 carbon atoms, and (4) the balance is water.

The fatty acid moiety of the fatty acid diethanolamide (a) has 10 to 14 carbon atoms, and it can be derived from a natural oil or fat or it can be a synthetic product. It is preferred to use coconut fatty acid containing large quantities of fatty acids having a carbon number in the above range. Fatty acids derived from palm oil can also be used.

The amphoteric surface active agent (b) can be prepared according to a known method. For example, it can be prepared by reaction between an alkyl ($C_{10}$–$C_{14}$) dimethyl amine and monochloroacetic acid. A long-chain alkyl sulfobetaine having a similar structure is not useful for the purposes of the invention because compositions containing same are inferior in the antiredeposition effect.

because compositions containing same are inferior in the antiredeposition effect and solution stability.

In the cationic surface active agent (d) having the formula (III), the number of added ethylene oxide groups, namely the sum of *m* and *n*, is in the range of from 2 to 8, and if the number is outside this range, a satisfactory softening effect cannot be obtained.

The alkyl ethoxylate that is used in the present invention (ingredient 3) is prepared by adding 3 to 12 moles of ethylene oxide to a primary or secondary alcohol having 12 to 15 carbon atoms. As the starting alcohol, there can be used a higher alcohol formed by reducing a natural oil or fat, or a synthetic product.

The desired effects of the present invention are attained by the synergistic actions of the above-mentioned components (1), (2) and (3). If any of the three components is omitted, the effects of the invention cannot be attained. Further, the component (1) must include both of the ingredients (a) and (b), and if either of them is not incorporated, the intended effects of the invention cannot be attained. Likewise, the component (2) must include both the ingredients (c) and (d), and if either of these two ingredients is not incorporated, satisfactory effects cannot be attained.

The detergent composition of the present invention comprises 1 to 5% by weight of the component (1), 0.5 to 5% by weight of the component (2) and 15 to 30% by weight, preferably 20 to 25% by weight, of the component (3).

The composition of the present invention is liquid and its main component, other than the above-mentioned indispensable components (1), (2) and (3), is water. The composition of the present invention may optionally contain further additives indicated below, if needed.

(i) Fluorescent dyes such as those represented by the formulae (D), (E) and (F):

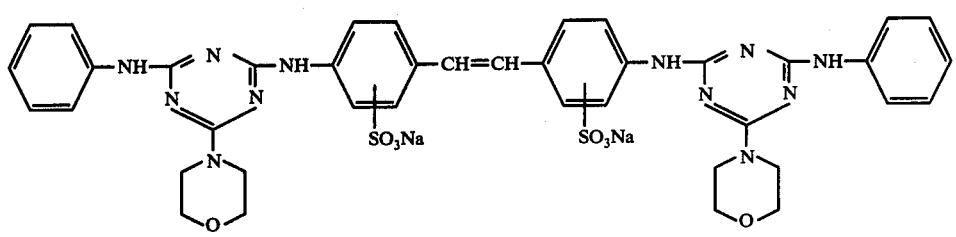

(D)

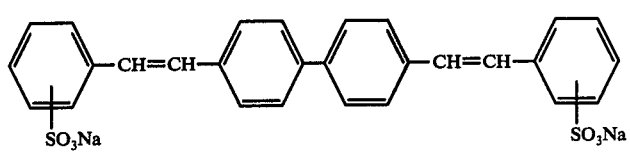

(E)

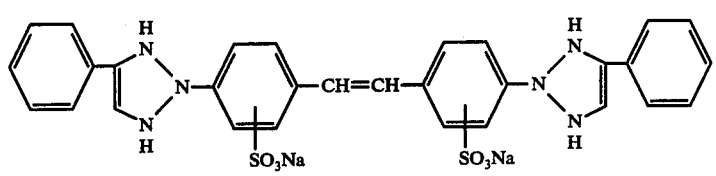

(F)

In the cationic surface active agent (c) having the formula (II), the carbon atom number of the alkyl or alkenyl group is 14 to 20, preferably 16 to 18. This component can be derived, for example, from a higher alcohol obtained by reducing tallow fatty acid. A cationic surface active agent having two long-chain alkyl groups is not useful for the purposes of the invention (ii) Viscosity-reducing agents such as lower alcohols, e.g., ethanol and isopropanol, and glycols, e.g., ethylene glycol and propylene glycol.

(iii) Perfumes.

(iv) Opacifying agents such as polyvinyl acetate, vinyl acetate-styrene copolymers and polystyrene.

EXAMPLE 1

Liquid light-duty detergents having a formulation as described below were prepared by using various antiredeposition agents and they were tested with respect to the antiredeposition effect, the solution stability and the softening effect. The results obtained are shown in Table 1.

| Formulation: | |
|---|---|
| Antiredeposition agent (shown in Table 1) | 1.2 wt.% |
| $[R-{}^{\oplus}N(CH_3)_3]Cl^{\ominus}$ : $\left[R-{}^{\oplus}N(CH_2CH_2O)_nH\ (CH_2CH_2O)_mH\right]Cl^{\ominus}$ = 1/1 (by weight) | 2.0 wt.% |
| (R is a mixture of groups having 16 10 18 carbon atoms, n + m = 8) | |
| Secondary alcohol ethoxylate (carbon atom number of alcohol being 12 to 14, added ethylene oxide mole number = 7) | 20 wt.% |
| Fluorescent dye | 0.01 wt % |
| Ethanol | 5 wt.% |
| Perfume | 0.1 wt.% |
| Service water | balance |

Antiredeposition test:

Five wool muslin cloths (10 cm × 10 cm) were added to 500 ml of a 0.25% detergent aqueous solution containing 0.1 g of carbon black dispersed therein, and the bath was agitated at 100 rpm and 20° C for 10 minutes by using a Terg-O-Tometer. The wool muslin cloths were taken out from the detergent solution and were rinsed in running water. Then, the rinsed muslin cloths were dried and the whiteness was classified according to the following scale to evaluate the antiredeposition effect:

O: as white as the wool muslin before the treatment

Δ: slightly blacker than the wool muslin before the treatment

X: much blacker than the wool muslin before the treatment

Solution stability test:

An Erlenmeyer flask charged with a detergent solution to be tested was dipped in an ice water bath maintained at 0° C for 1 hour, and then was inspected to determine the appearance thereof. The low temperature stability was evaluated according to the following scale:

A: transparent solution

B: slightly turbid

C: completely turbid or phase separation occurred

Softening test:

An acrylic jersey cloth having a size of 20 cm × 60 cm was hand-washed with 4 l of a 0.25% detergent aqueous solution maintained at 30° C, and it was then air-dried and subjected to the touch test by a panel consisting of 10 men. The softness was evaluated according to the following scale:

● : softer than before washing

▲ : as soft as before washing

■ : harder than before washing

Table 1

Properties of Various Detergents

| No. | Antiredeposition Agent | Effect | Solution Stability | Softening Effect | Remarks |
|---|---|---|---|---|---|
| (1) | none | X | B | ● | comparison |
| (2) | polyethylene glycol (average molecular weight=200) | X | B | ● | " |
| (3) | ditto (average molecular weight=6000) | X | C | ● | " |
| (4) | polyvinyl alcohol (Gosenol GL-05) | X | C | ● | " |
| (5) | polyvinyl pyrrolidone | X | C | ● | " |
| (6) | coconut fatty acid diethanolamide | O | A | ▲ | " |
| (7) | lauryldimethyl betaine | X | A | ● | " |
| (8) | lauryldimethyl sulfobetaine | Δ | A | ● | " |
| (9) | lauryldimethyl amine oxide | Δ | A | ● | " |
| (10) | primary alcohol ($C_{12}$) ethoxylate (added ethylene oxide mole number=8) | X | A | ▲ | " |
| (11) | (7)/(8)=1/1 (weight ratio) | X | A | ● | " |
| (12) | (7)/(9)=1/1 (weight ratio) | Δ | A | ● | " |
| (13) | (6)/(7)=1/1 (weight ratio) | O | A | ● | present invention |
| (14) | (6)/(8)=1/1 (weight ratio) | Δ | A | ▲ | comparison |
| (15) | (6)/(9)=1/1 (weight ratio) | Δ | A | ▲ | " |
| (16) | (8)/(9)=1/1 (weight ratio) | Δ | A | ● | " |
| (17) | (6)/(10)=1/1 (weight ratio) | Δ | B | ■ | " |

As will be apparent from the results shown in Table 1, among the various non-ionic and amphoteric surface active substances that are considered to be capable of being mixed with a cationic surface active agent, only sample (13) comprising the combination of coconut fatty acid diethanolamide and an alkyl dimethyl (carboxy)betaine, maintained a transparent state at low temperatures and exhibited a satisfactory antiredeposition effect without degrading the softening effect of the cationic surface active agent.

EXAMPLE 2

Cationic surface active agents that can be combined with the antiredeposition agent of the present invention were examined.

| Formulation: | |
|---|---|
| Coconut fatty acid diethanolamide/ lauryldimethyl betaine (wt. ratio = 1/1) | 1.2 wt. % |
| Cationic surface active agent (shown in Table 2) | 2.0 wt. % |
| Secondary alcohol ethoxylate (alcohol carbon atom number=12 - 14, added ethylene oxide mole number=7) | 20 wt. % |
| Fluorescent dye | 0.01 wt. % |
| Ethanol | 5 wt. % |
| Perfume | 0.1 wt. % |
| Service water | balance |

The tests were conducted in the same manners as described in Example 1. The results obtained are shown in Table 2.

Table 2

| No. | Cationic Surface Active Agent | Properties of Various Detergents: Antiredeposition Effect | Solution Stability | Softening Effect | Remarks |
|---|---|---|---|---|---|
| (18) | none | | | | comparison |
| (19) | 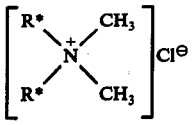 | Δ | C | ● | " |
| (20) | 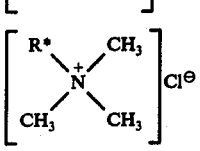 | Δ | B | ● | " |
| (21) | 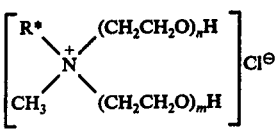 m+n=2 | O | A | ▲ | " |
| (22) | m+n=2 m+n=8 | O | A | ▲ | " |
| (23) | m+n=2 m+n=15 | O | A | ▲ | " |
| (24) | (19)/(22)=1/1 (weight ratio) | Δ | B | ● | " |
| (25) | (20)/(21)=1/1 (weight ratio) | O | A | ● | present invention |
| (26) | (20)/(22)=1/1 (weight ratio) | O | A | ● | " |
| (27) | (20)/(23)=1/1 (weight ratio) | O | A | ▲ | comparison |

Note
R*: hydrocarbon group derived from beef tallow

As will be apparent from the results shown in Table 2, among the various cationic surface active agents and mixtures thereof, only mixtures of cationic surface active agents (25) and (26) attain the effects desired in the present invention.

EXAMPLE 3

The effects of various non-ionic surface active agents were examined.

Formulation:

| | | |
|---|---|---|
| Coconut fatty acid diethanolamide | 2.5 | wt. % |
| Lauryldimethyl betaine | 2.0 | wt. % |
| 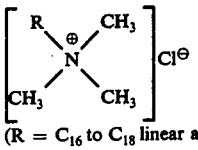 (R = $C_{16}$ to $C_{18}$ linear alkyl group) | 0.5 | wt. % |
| 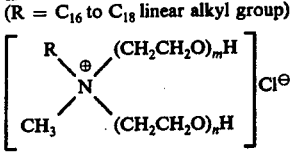 | 2.0 | wt. % |

-continued

| Formulation: | | |
|---|---|---|
| (m+n=8, R=$C_{16}$ to $C_{18}$ linear alkyl group) Polyoxyethylene alkyl ether (shown in Table 3) | 22 | wt. % |
| Fluorescent dye | 0.05 | wt. % |
| Ethanol | 6 | wt. % |
| Perfume | 0.2 | wt. % |
| Service water | balance | |

The tests were conducted in the same manners as described in Example 1.

Table 3

| No. | Polyoxyethylene Alkyl Ether: Starting alcohol | Added ethylene oxide mole number | Properties of Various Detergents: Anti-redeposition Effect | Solution Stability | Softening Effect | Remarks |
|---|---|---|---|---|---|---|
| (28) | $C_{12}$-$C_{14}$, secondary | 1 | Δ | C | ▲ | comparison |
| (29) | " | 2 | Δ | B | ▲ | " |
| (30) | " | 3 | O | A | ● | present invention |
| (31) | " | 7 | O | A | ● | " |
| (32) | " | 9 | O | A | ● | " |
| (33) | " | 12 | O | A | ● | " |
| (34) | " | 14 | Δ | B | ● | comparison |
| (35) | $C_{16}$, linear, primary | 12 | O | B | ● | " |
| (36) | $C_{12}$-$C_{13}$, oxoalcohol | 9 | O | A | ● | present invention |
| (37) | $C_{14}$-$C_{15}$, oxoalcohol | 9 | O | A | ● | " |

From the results shown in Table 3, the polyoxyethylene alkyl ethers capable of attaining the desired effects of the present invention are limited to those formed by adding 3 to 12 moles of ethylene oxide to one mole of a primary or secondary alcohol having 12 to 15 carbon atoms.

EXAMPLE 4

The amounts and mixing ratios of the antiredeposition agents were examined by conducting the tests in the same manner as described in Example 1. The results obtained are shown in Table 4.

Table 4

Properties of Various Detergents

| Components | Sample No. (38) | (39) | (40) | (41) | (42) | (43) |
|---|---|---|---|---|---|---|
| coconut fatty acid diethanolamide | 0.25 | 0.5 | 1.5 | 4.5 | 6.3 | 0.7 |
| coco-alkyl dimethyl betaine | 0.25 | 4.5 | 3.5 | 0.5 | 0.7 | 6.3 |
| (tallow alkyl)trimethyl ammonium chloride | 1 | 1 | 1 | 1 | 1 | 1 |
| bis(polyethenoxy)-mono-tallow-alkyl ammonium chloride [m+n=8 in formula (III)] | 1 | 1 | 1 | 1 | 1 | 1 |
| Secondary alcohol ($C_{12}$–$C_{14}$) ethoxylate (average added ethylene oxide number=9) | 20 | 20 | 20 | 20 | 20 | 20 |
| fluorescent dye | 0.01 | 0.01 | 0.01 | 0.01 | 0.01 | 0.01 |
| ethanol | 7 | 7 | 7 | 7 | 7 | 7 |
| perfume | 0.1 | 0.1 | 0.1 | 0.1 | 0.1 | 0.1 |
| service water | balance | balance | balance | balance | balance | balance |
| Antiredeposition Effect | X | O | O | O | O | Δ |
| Solution Stability | B | A | A | A | A | A |
| Softening Effect | ● | ● | ● | ● | ▲ | ● |
| Remarks | comparison | present invention | present invention | present invention | present invention | comparison |

As will be apparent from the results shown in Table 4, the desired effects of the present invention can be attained when the amount of a mixture of the fatty acid diethanol amide (a) and the alkyldimethyl betaine (b) contained in the detergent composition is in the range of 1 to 5 wt.% and the mixing (a)/(b) ratio is in the range of from 10/90 to 90/10.

EXAMPLE 5

The amounts and mixing ratios of the cationic surface active agents in the formulation of Example 2 were examined by conducting the test in the same manners as described in Example 1. The results obtained are shown in Table 5.

Table 5

| Solution No. | Amounts (wt.%) of Incorporated Cationic Surface Active Agents: $\left[R^*\underset{CH_3}{\overset{CH_3}{N^{\oplus}}}CH_3\right]Cl^{\ominus}$ (m+n=8) | $\left[R^*\underset{CH_3}{\overset{(CH_2CH_2O)_nH}{N^{\oplus}}}(CH_2CH_2O)_mH\right]Cl^{\ominus}$ | Antiredeposition Effect | Solution Stability | Softening Effect | Remarks |
|---|---|---|---|---|---|---|
| (44) | 0 | 0.5 | O | A | ▲ | comparison |
| (45) | 0.25 | 0.25 | O | A | ● | present invention |
| (46) | 0.25 | 1.75 | O | A | ● | " |
| (47) | 0.5 | 4.5 | O | A | ● | " |
| (48) | 4.5 | 0.5 | O | A | ● | " |
| (49) | 5 | 1 | Δ | C | ● | comparison |
| (50) | 1 | 5 | Δ | B | ● | " |

Note
R*: linear alkyl group having 16 to 18 carbon atoms

As will be apparent from the results shown in Table 5, the desired effects of the present invention can be attained when the amount of a mixture of the monoalkyltrimethyl ammonium salt (c) and the bis(polyethenoxy)monoalkylmethyl ammonium salt (d) contained in the detergent composition is in the range of 0.5 to 5 wt.% and the mixing (c)/(d) ratio is in the range of from 10/90 to 90/10.

EXAMPLE 6

The amount of the non-ionic surface active agent in the formulation of Example 3 was examined by conducting the tests in the same manners as described in Example 1. More specifically, the polyoxyethylene alkyl ether formed by adding 7 moles of ethylene oxide to one mole of a $C_{12}$ to $C_{14}$ secondary alcohol was incorporated in an amount of 5, 10, 15, 20, 25, 30 or 40 wt.%. When the amount incorporated was 5, 10 or 40 wt.%, the resulting solution was whitely turbid. When the amount incorporated was 40 wt.%, the softening effect was degraded. The desired effects of the present invention were attained if the amount incorporated was 15, 20, 25 or 30 wt.%. Especially good effects were obtained when the amount incorporated was either 20 or 25 wt.%.

EXAMPLE 7

The detergent composition of the present invention was compared with commercially available light-duty detergents with respect to the washing power.

| Detergent Composition of Present Invention: | | |
|---|---|---|
| Coconut fatty acid diethanolamide | 1 | wt. % |
| Coco-alkyldimethyl carboxy-betaine | 0.5 | wt. % |
| $\left[R\overset{CH_3}{\underset{CH_3}{\overset{\oplus}{N}}}CH_3\right]Cl^-$ (R=$C_{16}$–$C_{18}$ alkyl group) | 1 | wt. % |
| $\left[R\overset{CH_3}{\underset{(CH_2CH_2O)_nH}{\overset{\oplus}{N}}}(CH_2CH_2O)_mH\right]Cl^-$ (R=$C_{16}$–$C_{18}$ alkyl group, m+n=8) | 1 | wt. % |
| Secondary alcohol ($C_{12}$–$C_{14}$) ethoxylate (average added ethylene oxide mole number=9) | 20 | wt. % |
| Secondary alcohol ($C_{12}$–$C_{14}$) ethoxylate (average added ethylene oxide mole number=3) | 3 | wt. % |
| Fluorescent dye (Tinopal CBS | 0.05 | wt. % |

-continued

| Detergent Composition of Present Invention: | | |
|---|---|---|
| manufactured by Ciba Geigy) | | |
| Ethanol | 5 | wt. % |
| Perfume | 0.1 | wt % |
| Service water | balance | |

Commercially Available Light-duty Detergent A (powder):

An anionic surface active agent is contained in an amount of about 30 wt.%, as the main component.

Commercially Available Light-duty Detergent B (liquid):

A mixture of an anionic surface active agent and non-ionic surface active agent is contained in an amount of about 25 wt.%, as the main component.

Washing Test

Artificially Soiled Cloth:

Wool and acrylic cloths (10 cm × 10 cm) were soiled with an artificial oily soil designated by the Japanese Association of Oil Chemistry and a minute amount of carbon black and these cloths were tested as artificially soiled cloths.

Washing Machine:

Terg-O-Tometer (100 rpm)

Washing Conditions:

Washing water: service water

Temperature: 30° C

Washing Time: 10 minutes

Bath ratio: 1/60

Detergent concentration: 0.25%

Calculation of Washing Ratio:

The reflectance at 550 mμ of the soiled cloth was measured before and after the washing treatment by using an automatic colorimeter (manufactured by Shimazu Seisakusho), and the washing ratio was calculated according to the following formula:

$$\text{Washing Ratio} = \frac{R_1 - R_2}{R_0 - R_2} \times 100$$

wherein $R_0$ stands for the reflectance of a white cloth before washing, $R_1$ stands for the reflectance of the artificially soiled cloth after washing, and $R_2$ stands for the reflectance of the artificially soiled cloth before washing. The results obtained are shown in Table 6.

Table 6

Washing Ratios of Various Detergents

| Detergent | Cloth: Wool | Cloth: Acrylic |
|---|---|---|
| detergent of present invention | 55 | 48 |
| commercially available light-duty detergent A | 53 | 47 |
| commercially available light-duty detergent B | 30 | 38 |

The embodiments of the invention in which an exclusive property or privilege is claimed are defined as follows:

1. A liquid light-duty detergent composition consisting essentially of (1) from one to 5% by weight of a mixture of (a) a fatty acid diethanolamide derived from a saturated fatty acid having 10 to 14 carbon atoms and (b) an amphoteric surface active agent having the formula (I):

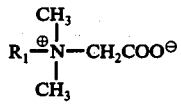

(I)

wherein $R_1$ is alkyl having 10 to 14 carbon atoms, wherein the weight ratio of the fatty acid diethanolamide (a) to the amphoteric surface active agent (b) is in the range of from 90/10 to 10/90, (2) from 0.5 to 5% by weight of a mixture of (c) a cationic surface active agent having the formula (II):

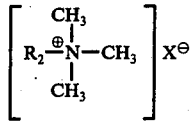

(II)

wherein $R_2$ is alkyl or alkenyl having 14 to 20 carbon atoms, and X is cl or Br, and (d) a cationic surface active agent having the formula (III):

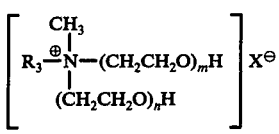

(III)

wherein $R_3$ is alkyl or alkenyl having 14 to 20 carbon atoms, *m* and *n* each is an integer of at least one, with the proviso that the sum of *m* and *n* is in the range of from 2 to 8, and *x* is Cl or Br, wherein the weight ratio of the cationic surface active agent (c) to the cationic surface active agent (d) is in the range of from 90/10 to 10/90, (3) from 15 to 30% by weight of an alkyl ethoxylate formed by adding 3 to 12 moles of ethylene oxide to one mole of an alcohol having 12 to 15 carbon atoms, and (4) the balance is essentially water.

2. A liquid light-duty detergent composition according to claim 1 wherein the fatty acid diethanolamide (a) is derived from coconut fatty acid.

3. A liquid light-duty detergent composition according to claim 1 wherein in the cationic surface active agent (c) having the formula (II), the alkyl or alkenyl group $R_2$ has 16 to 18 carbon atoms.

4. A liquid light-duty detergent composition as set forth in claim 1 wherein in the cationic surface active agent (d) having the formula (III), the alkyl or alkenyl group $R_3$ has 16 to 18 carbon atoms.

5. A liquid light-duty detergent composition as set forth in claim 1 wherein the content of the alkyl ethoxylate (3) is from 20 to 25% by weight.

* * * * *